US005780842A

United States Patent [19]

Murphey

[11] Patent Number: 5,780,842

[45] Date of Patent: Jul. 14, 1998

[54] ITEM DISPENSING CONTROL SYSTEM FOR USE IN VENDING DEVICES

[76] Inventor: James D. Murphey, 2438 W. Butler, Phoenix, Ariz. 85021

[21] Appl. No.: 909,295

[22] Filed: Aug. 11, 1997

Related U.S. Application Data

[63] Continuation of Ser. No. 630,784, Apr. 10, 1996, abandoned.

[51] Int. Cl.[6] ..... H01J 40/14

[52] U.S. Cl. ..... 250/222.1; 194/207; 221/6

[58] Field of Search ..... 250/222.1; 221/2, 221/6, 9, 13; 194/206, 207

[56] References Cited

U.S. PATENT DOCUMENTS

| | | | |
|---|---|---|---|
| 3,805,937 | 4/1974 | Hatanaka et al. | 194/4 R |
| 4,359,147 | 11/1982 | Levasseur | 194/1 |
| 4,519,522 | 5/1985 | McElwee | 221/13 |
| 4,812,985 | 3/1989 | Hambrick et al. | 364/478 |
| 4,817,010 | 3/1989 | Dobbins | 364/479 |
| 4,871,054 | 10/1989 | Murray | 194/212 |
| 5,139,384 | 8/1992 | Tuttobene | 414/281 |
| 5,272,323 | 12/1993 | Otsuka et al. | 235/381 |
| 5,385,265 | 1/1995 | Schlamp | 221/7 |
| 5,415,264 | 5/1995 | Menoud | 194/217 |

*Primary Examiner*—Edward P. Westin
*Assistant Examiner*—Kevin Pyo
*Attorney, Agent, or Firm*—Parsons & Goltry; Robert A. Parsons; Michael W. Goltry

[57] ABSTRACT

A dispensing device has a photovoltaic vending actuator including a light source coupled to a currency collector, supplying a beam of light at a first wavelength when proper currency is inserted in the currency collector. A light modifying device is positioned to receive the beam of light from the light source and to transmit a beam of light at a second wavelength. A light detector is sensitive to light at the second wavelength and positioned to receive the beam of light from the light modifying device. A circuit is coupled to the light detector for dispensing an item when actuated by the light detector.

16 Claims, 2 Drawing Sheets

ITEM DISPENSING CONTROL SYSTEM FOR USE IN VENDING DEVICES

This application is a continuation of application Ser. No. 08/630,784 filed 10 Apr. 1996, now abandoned.

BACKGROUND OF THE INVENTION

1. Field of the Invention

This invention relates to item and product dispensing devices.

More particularly, the present invention relates to control of items and products dispensed by dispensing devices.

In a further and more specific aspect, the instant invention relates to authenticating the dispensing of items and products from dispensing devices.

2. Prior Art

The vending industry is becoming increasingly plagued by fraud and cheating. Manipulation and illicited substitution of the products by vendor, vending machine operators, service personnel and employees is one of the biggest problems faced by product producers and owners of vending machines and vending companies. The perpetrator of the fraud may be held liable; however, the fraud and cheating is very difficult to detect, and generally is not detected unless taken to an extreme.

Profits in the vending industry are produced through the sale of items with which the machines are stocked. A large percentage of profits produced from vending machines is lost through the replacement of dispensed items from unauthorized sources or through the switching of stocked items with unauthorized items. Many attempts have been made to curtail these activities through the use of in-machine accounting and inventorying devices. These attempts have met with such limited success that the industry typically figures the losses directly into the overhead cost of operation. This extra cost is passed on to the consumer with increased prices for dispensed items.

The dispense circuit in all automatic vending machines is integrated with the selection panel switches for direct activating of the product dispense device. Therefore, the dispense device can only react to the selection switch signal and cannot discriminate or discern authenticity of a product. The dispense device cannot relate to the product; thus, there is no dispense-to-product control. A machine type to product category (soft drink, snacks, coffee, etc.) determines the type of product. This validates the product, yet, does not authenticate it to the out-means. The signal from a coin receptor activated by the deposit of correct currency merely engages the selection panel switches. After deposit, when a selection switch is pushed, a signal directly activates the appropriate dispense device. Simply, there are no provisions to insure that the product being dispensed is the same product that was intended for dispensing. Thus, a machine cannot prevent illicit substitution of the same or like products by those with in-machine access.

In-machine accounting and inventorying devices have greatly increased in complexity and cost with the introduction of microprocessors. The use of microprocessors and bar coding information on items to be dispensed permits accounting and inventory tracking. In other words, the item carries a bar code which contains information as to the type and cost of the item. These devices, however, depend on accurate stocking of the vending machine or accurate input of data about the items. Any dishonest individual with access to the interior of the vending machine may replace in machine items resulting in erroneous data. Furthermore, the cost of these machines is enormous, resulting in greater cost to the consumer.

It would be highly advantageous, therefore, to remedy the foregoing and other deficiencies inherent in the prior art.

Accordingly, it is an object of the present invention to provide a new and improved dispensing apparatus.

Another object of the present invention is to provide a control system for use in a dispensing apparatus.

And another object of the present invention is to provide a control system for controlling the dispensing of items and dispensable products.

Yet another object of the present invention is to providing a control system that prevents in machine exchanges of items and products.

Still another object of the present invention is to providing a control system which prevents stocking of dispensing machines with unauthorized items and products.

SUMMARY OF THE INVENTION

Briefly, to achieve the desired objects of the instant invention in accordance with a preferred embodiment thereof, provided is a dispensing device including a light source coupled to a coin collector, supplying a beam of light at a first wavelength when a coin is inserted in the coin collector. A light wavelength modifying device positioned to receive the beam of light from the light source and transmitting a beam of light at a second wavelength. A light detector sensitive to light at the second wavelength and positioned to receive the beam of light from the wavelength modifying device. A circuit is coupled to the light detector for dispensing an item when actuated by the light detector.

Further provided is a method of operating a dispensing device including the steps of providing a dispensing device described above and stocking the dispensing device with items including the light modifying device such that the light modifying device carried by the item in the dispense position is positioned to receive the beam of light from the light source.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which.

DESCRIPTION OF THE PREFERRED EMBODIMENT

Figure 1:
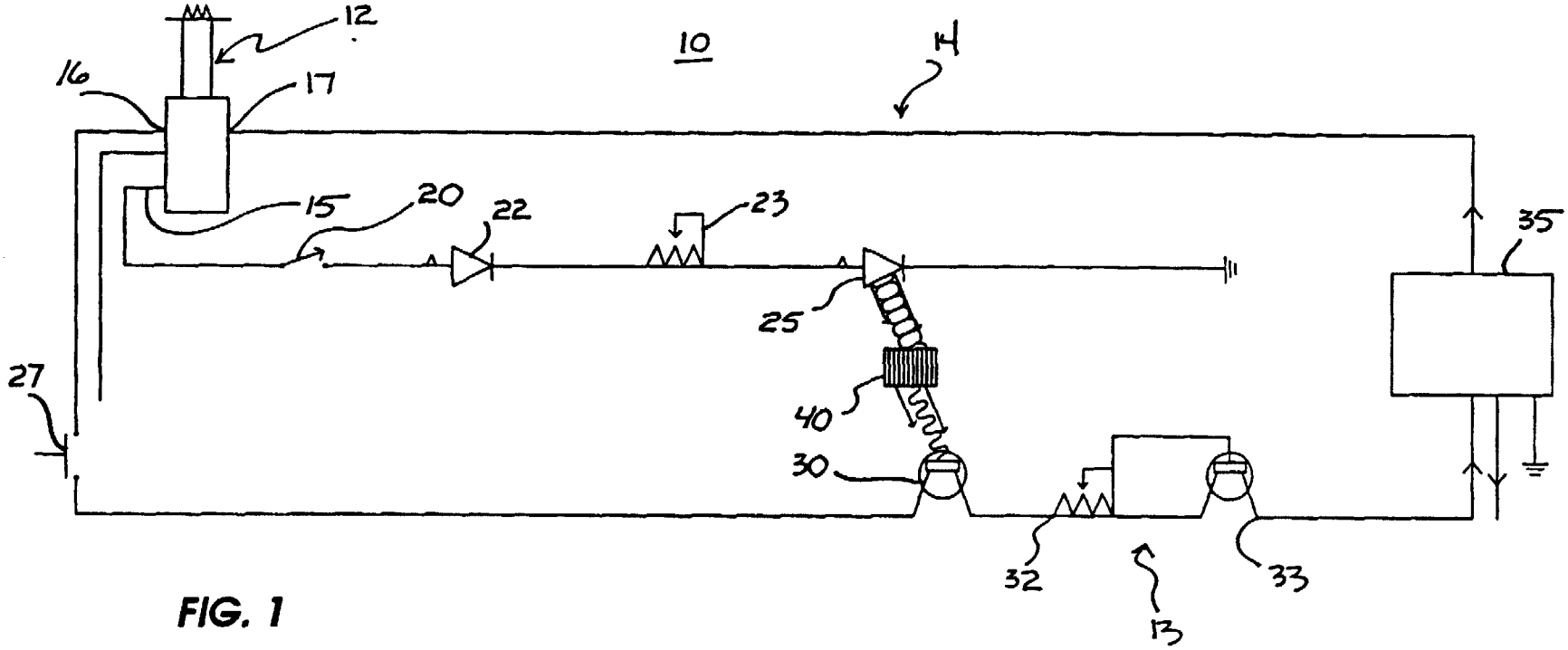
FIG.1 is a simplified block/schematic diagram of a dispensing device with a control system in accordance with the present invention.

Turning now to the drawings, in which like reference characters indicate corresponding elements throughout the several views, attention is first directed to FIG. 1 which illustrates a dispensing device 10 including a currency receptor 12, and a control system 13 for controlling the operation of a dispensing circuit 14. It will be understood from the following description that control system 13 may be used on substantially any dispensing device having an activation device such as currency receptor 12 and a dispensing circuit for dispensing items. It will be further understood that currency collector may be substantially any device which initiates the dispense cycle of a dispensing device, and may include coin, bill or credit receptors, circuit-inline electrical contacts, etc.

Currency receptor 12 is a standard element which is well known in the art, and which upon receiving currency such as coins or bills of specific denominations, closes one or more contacts, thereby applying a voltage to output terminals. In the present specific embodiment, for example, when the correct coins are inserted, a positive voltage is applied to an output terminal 15 and to an output terminal 16. Also, a reset circuit is connected to an input terminal 17.

The positive voltage on terminal 15 is applied through a selection switch 20, a protective diode 22, and a variable resistor 23 to one side of a light source, the other side of which is grounded. The light source in this embodiment is preferably an infrared (IR) light emitting diode (LED) 25. The positive voltage on terminal 16 is applied through a door switch 27, a light detector 30, a variable resistor 32, and a supporting protective diode 33 to one side of an item dispense apparatus 35, the other side of which is grounded. It should be understood that diode 33 in this embodiment is a diode connected JFET. Utilizing a JFET in diode 33 provides some variability in the circuit to improve the policing aspect as well as the electrical characteristics. The JFET may be turned totally off, on, or operated anywhere in-between according to the setting of resistor 32. Further, the JFET doubles the effect of resistor 32 and protects against line current overload to dispense apparatus 35. When only a diode is utilized as diode 33, it can only pass or block current which can create a possibility of overheating. Variable resistor 32 and diode 33 provide mutual protection against overheating and too much current. Item dispense apparatus 35 also provides a reset signal which is connected to terminal 17. It will be understood that in dispensing devices containing more than a single item selection, each item selection will require a separate control system 13 and a separate dispensing circuit 14. Control system 13 generally includes LED 25, and light detector 30. Variable resistors 23 and 32 may or may not be used as desired, their function is described subsequently. Dispensing circuit 14 generally includes those elements found in conventional dispensing apparatus which perform the dispense cycle initiated by currency receptor 12. These elements generally include output terminal 16, the reset circuit coupled to input terminal 17, selection switch 20 and item dispense apparatus 35.

When the correct coins are inserted in currency receptor 12 and selector switch 20 is closed by a customer thereby choosing a desired item selection, a positive voltage is applied from terminal 15 and LED 25 is activated to emit light having a set of characteristics. Variable resistor 23 is employed to control the amount of current flowing into LED 25 thereby determining the intensity (luminance) of the light emitted. In a first example, to prevent inadvertent activation or dispensing of items, LED 25 can be chosen to emit light outside of the ambient light range. In a second example, inadvertent activation or dispensing of items can be prevented by adjusting resistor 23 to actuate LED 25 to emit light with an intensity well in excess of any ambient light leakage as will be described presently. LED 25 may be chosen to emit in the infrared range and its light is scattered as is normal with LEDs.

A light modifying device 40 is positioned to receive light from LED 25. Light modifying device 40 is designed to receive the light from LED 25 and transmit light having a set of characteristics in which one of those characteristics differs from a corresponding characteristic of the light from LED 25. For example, the set of characteristics of the light may include wavelength (color or frequency), intensity, polarization, refraction, etc. Light modifying device 40 receives light from LED 25, and changes one or more of the characteristics, such as wavelength, and emits the light having the different characteristics to light detector 30. In the preferred embodiment, device 40 includes fluorescent material, such as phosphor or actinical materials, affixed to an item to be dispensed as indicia or a label. Actinical is a dielectric, which includes and encompasses all light reagents, such as silicon, phosphor, fluorescence, radium, platinocyanide; whether chemical, bio, metal, gases, or oxidants; anything acting, responding, or changeable by light radiation. The fluorescent material may be applied directly to the item or to a label subsequently affixed to the item. Upon receiving light from LED 25, the luminescent material is activated to emit light with an altered characteristic to light detector 30. Light detector 30 is designed in coordination with system 13, to be activated by the specific light with the altered characteristic generated by device 40.

Activation of light detector 30 completes circuit 14, activating dispensing apparatus 35 to dispense the chosen item. Here it should be noted that door switch 27 is also included in circuit 14, requiring the door to be closed to complete the circuit. This limitation prevents internal tampering during the dispensing cycle, preventing artificial stimulation of light detector 30. Also, variable resistor 32 is included in circuit 14 to control the amount of current flowing to dispensing apparatus 35. The current flow is adjustable to provide the current needed to activate dispensing apparatus 35 and distinguish the amount of altered light radiation required to activate light detector 30.

By employing light modifying devices on items to be dispensed, the items dispensed can be controlled by circuit 10, providing item authenticity and policing ability for vending machine operators or owners. If an item stocked in the dispensing device does not have a proper light modifying device 40 affixed thereto, the dispense cycle is never completed and the item will not be dispensed. This prevents unauthorized item substitution inside the dispenser. When an item including light modifying device 40 is supplied or labels are supplied for use on items to be dispensed, light from LED 25 will be altered as desired and this altered light will be received by light detector 30. Only if the specific characteristic or characteristics of the light are altered will dispensing of an item occur.

Figure 2:
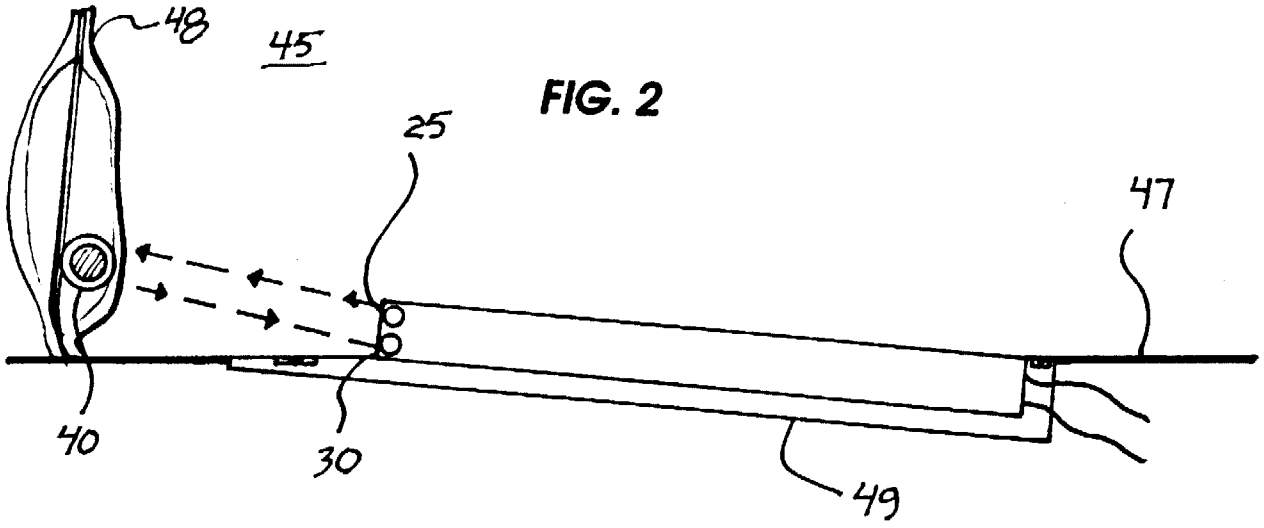
FIG.2 is a side view illustrating portions of a dispensing device.

Turning now to FIG. 2, the positioning of the elements of control system 13 for proper interaction are shown as they would appear in a multi-item dispensing device 45, of which a portion is illustrated. Dispensing device 45 is of the type including a plurality of shelves, only one designated 47 of which is shown, which carry rows of the items to be dispensed. Only one item 48 in the dispense position is illustrated. The dispensing device is not illustrated in detail as it is well known in the art, and the illustration is merely intended to show the placement of LED 25 and light detector 30 in relation to item to be dispensed 48. LED 25 and light detector 30 are carried together in a casement 49 which is in turn, carried by shelf 47. In this embodiment, casement 49 is recessed below the surface of shelf 47 with only a small portion containing the apertures of LED 25 and light detector 30 projecting above. The protruding portions of LED 25 and light detector 30 are small, permitting items to be dispensed to slide easily thereover into the dispense position as is item 48. Once in the dispense position, item 48 including light modifying device 40 affixed to a back portion thereof is positioned for light from LED 25 to strike light modifying device 40. Light emitted from light modifying device 40 is directed at light detector 30.

Thus, upon insertion of the correct currency and selection of an item desired from the selection, LED 25 will direct a beam of light at the item in the dispense position. If that item includes light modifying device 40 in a proper position, the light will be modified and emitted back to light detector 30, allowing the dispense cycle to continue.

Figure 3:
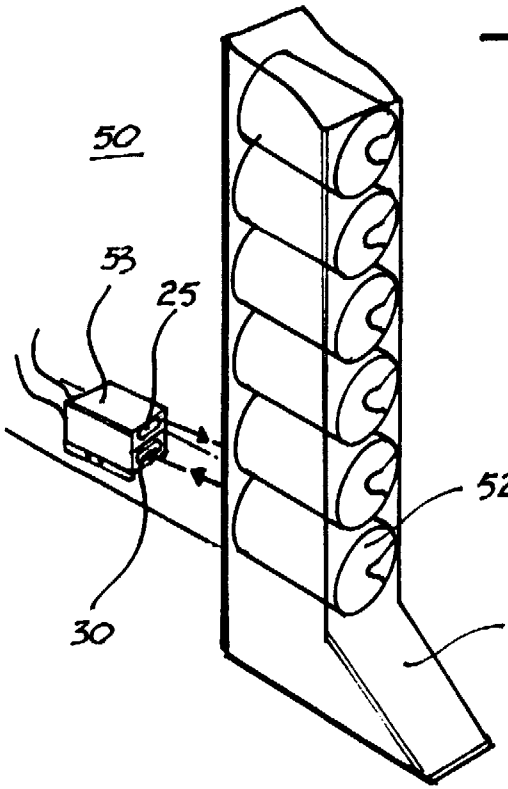
FIG. 3 is an isometric view illustrating portions of a dispensing device.

Turning now to FIG. 3, yet another dispensing device 50 employing control system 13 is illustrated to show that many different types and styles of dispensing machines may include control system 13. Dispensing device 50, only a portion of which is illustrated, is a conventional soft drink vending machines. Device 50 includes a plurality of columns 51 containing soft drink cans, only one of which is illustrated and described subsequently, including one can 52 in the dispense position. Each of the cans include light modifying device 40 affixed to the bottom thereof, not visible. LED 25 and light detector 30 are carried together in a casement 53 which is ,in turn, carried by column 51 behind can 52 in the dispense position. Since casement 53 is set back from the cans in column 51, after the dispense cycle, the next can moving into the dispense position will not be hindered. Once in the dispense position, can 52 including light modifying device 40 affixed to a bottom portion thereof is positioned for light from LED 25 to strike light modifying device 40. Light emitted from light modifying device 40 is directed at light detector 30.

Thus, upon insertion of the correct currency and selection of an item desired from the selection provided, LED 25 will direct a beam of light at the item in the dispense position. If that item includes light modifying device 40 in a proper position, the light will be modified and emitted back to light detector, allowing the dispense cycle to continue.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

What is claimed is:

1. A dispensing device comprising:

a light source coupled to a currency collector, supplying a beam of light having a first set of characteristics when currency is inserted in the currency collector;

a light modifying device positioned on an item to be dispensed to receive the beam of light from the light source, the light modifying device receiving the beam of light and transmitting a beam of light having a second set of characteristics wherein at least one characteristic of the second set differs from a corresponding characteristic of the first set;

a light detector acting as a switch and limited to only sensing light including the second set of characteristics and positioned to receive the beam of light from the light modifying device; and a dispensing circuit coupled to the light detector for dispensing the item when the circuit is completed by the actuation of the light detector.

2. A dispensing device as claimed in claim 1 wherein the light source is a light emitting diode.

3. A dispensing device as claimed in claim 1 wherein the light modifying device includes indicia positioned on the item to be dispensed.

4. A dispensing device as claimed in claim 3 wherein the indicia positioned on the item to be dispensed includes fluorescent material energized by the light having the first set of characteristics to emit light having the second set of characteristics.

5. A dispensing device as claimed in claim 4 wherein the beam of light having the first set of characteristics includes the beam of light having a first wavelength, and the beam of light having the second set of characteristics includes the beam of light having a second wavelength.

6. A dispensing device comprising:

a light source coupled to a currency collector, supplying a beam of light at a first wavelength when currency is inserted in the currency collector;

a light wavelength modifying device positioned on an item to be dispensed to receive the beam of light from the light source, the light wavelength modifying device receiving the beam of light and transmitting a beam of light at a second wavelength;

a light detector acting as a switch and limited to sensing light only at the second wavelength and positioned to receive the beam of light from the wavelength modifying device; and a circuit coupled to the light detector for dispensing the item when the circuit is completed by the actuation of the light detector.

7. A dispensing device as claimed in claim 6 wherein the light source is a light emitting diode.

8. A dispensing device as claimed in claim 6 wherein the light modifying device includes indicia positioned on the item to be dispensed.

9. A dispensing device as claimed in claim 8 wherein the indicia positioned on the item to be dispensed includes fluorescent material energized by the light of the first wavelength to emit light at the second wavelength.

10. A method of operating a dispensing device comprising the steps of:

providing a dispensing device including:

a light source coupled to a currency collector for supplying a beam of light having a first set of characteristics, when currency is inserted in the currency collector, a light modifying device positioned on an item to be dispensed to receive the beam of light from the light source and to transmit a beam of light having a second set of characteristics, a light detector acting as a switch and limited to only sensing light having the second set of characteristics, positioned to receive the beam of light from the light modifying device, a circuit coupled to the light detector for dispensing the item from a dispense position when the circuit is completed by the actuation of the light detector; and stocking the dispensing device with items including the light modifying device such that the light modifying device carried by the item in the dispense position is positioned to receive the beam of light from the light source upon reaching a dispense position.

11. A method as claimed in claim 10 further including the steps of:

inserting the proper currency into the currency receptor;

emitting a beam of light having the first set of characteristics from the light source upon receipt of the proper currency;

receiving the beam of light by the light modifying device;

emitting a beam of light having the second set of characteristics, wherein at least one characteristic of the second set differs from a corresponding characteristic of the first set of characteristics; and activating the circuit to dispense the item to be dispensed only if the second set of characteristics includes characteristics of a predetermined nature or origin.

12. A method as claimed in claim 11 wherein the step of providing a dispensing device includes providing a light modifying device including a label or indicia.

13. A method as claimed in claim 12 wherein the step of stocking includes positioning the label or indicia on the item to be dispensed.

14. A method as claimed in claim 13 wherein the label or indicia positioned on the item to be dispensed includes fluorescent material energized by the light having the first set of characteristics to emit light having the second set of characteristics.

15. A method as claimed in claim 11 wherein the first set of characteristics includes the beam of light having a first wavelength, and the second set of characteristics includes the beam of light having a second wavelength.

16. A method as claimed in claim 15 including in addition the step of positioning the light modifying device on the item to be dispensed which includes actinical material energized by the light of the first wavelength to emit light at the second wavelength.

* * * * *